US008490455B2

(12) United States Patent
Kubo

(10) Patent No.: US 8,490,455 B2
(45) Date of Patent: Jul. 23, 2013

(54) MOLD FOR PRESS APPARATUS, AND OPEN-DRAWING METHOD

(75) Inventor: Masao Kubo, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 555 days.

(21) Appl. No.: 12/678,593

(22) PCT Filed: Nov. 11, 2008

(86) PCT No.: PCT/JP2008/070464

§ 371 (c)(1),
(2), (4) Date: Mar. 17, 2010

(87) PCT Pub. No.: WO2009/069461

PCT Pub. Date: Jun. 4, 2009

(65) Prior Publication Data

US 2010/0201031 A1 Aug. 12, 2010

(30) Foreign Application Priority Data

Nov. 30, 2007 (JP) ..... 2007-310965

(51) Int. Cl.

| | |
|---|---|
| ***B21D 22/00*** | (2006.01) |
| *B21D 22/10* | (2006.01) |
| *B21D 28/18* | (2006.01) |
| *B21D 39/20* | (2006.01) |

(52) U.S. Cl.
USPC ..... 72/347; 72/60

(58) Field of Classification Search
USPC ..... 72/347, 348, 350, 60
See application file for complete search history.

(56) References Cited

U.S. PATENT DOCUMENTS 3,263,637 A * 8/1966 Cox ..... 72/347
4,615,205 A * 10/1986 Ragland, Jr. ..... 72/347

(Continued)

FOREIGN PATENT DOCUMENTS

JP 55-106524 U 7/1980
JP 63-313618 12/1988

(Continued)

OTHER PUBLICATIONS

Extended Search Report issued Sep. 5, 2011 in European Application No. 08855410.0.

(Continued)

*Primary Examiner* — Dana Ross
*Assistant Examiner* — Lawrence Averick
(74) *Attorney, Agent, or Firm* — Oblon, Spivak, McClelland, Maier & Neustadt, L.L.P.

(57) ABSTRACT

This aims to provide a press-apparatus mold capable of improving the yield of a blank while preventing wrinkles and cracks in a finished product, and an open-drawing method according to the press-apparatus mold. Within a range corresponding to the excess thickness portion (6) of a blank (4), the width of a punch (3) is gradually enlarged toward the end of the punch (3), thereby to curve boundaries (or the punch ridgelines (3*d* and 3*e*)) formed by the upper face (3*a*) and the side faces (3*b* and 3*c*) of the punch (3), toward the end of the punch (3) and to the widthwise outer sides of the punch (3). At the same time, the width of the recess (1*a*) of a die (1) is gradually enlarged toward the end of the recess (1*a*), thereby to curve a drawing profile (8) set by the punch (3) and the die (1), toward the ends of the punch (3) and the recess (1*a*) and to the widthwise outer sides of the punch (3) and the recess (1*a*).

4 Claims, 8 Drawing Sheets

U.S. PATENT DOCUMENTS

| | | | | |
|---|---|---|---|---|
| 4,719,787 | A * | 1/1988 | Ragland, Jr. | 72/347 |
| 4,833,903 | A * | 5/1989 | de Smet | 72/57 |
| 6,339,949 | B1 * | 1/2002 | Takamatu | 72/347 |
| 2008/0098789 | A1 * | 5/2008 | Hori et al. | 72/349 |

FOREIGN PATENT DOCUMENTS

| | | |
|---|---|---|
| JP | 1 197018 | 8/1989 |
| JP | 2 55624 | 2/1990 |
| JP | 4 46637 | 2/1992 |
| JP | 8 25097 | 1/1996 |
| JP | 2547772 | 10/1996 |
| JP | 2000 102824 | 4/2000 |

OTHER PUBLICATIONS

European search report Aug. 22, 2011, EP 08855410.

U.S. Appl. No. 12/674,074, filed Feb. 18, 2010, Kubo.

* cited by examiner

MOLD FOR PRESS APPARATUS, AND OPEN-DRAWING METHOD

TECHNICAL FIELD

The present invention relates to a mold for a press apparatus and an open-drawing method.

BACKGROUND ART

Conventionally, JP-8-25097-A discloses the art; in a corner portion of a cavity formed as a product shape, a gently projected or guttered portion is formed in the outside from the corner portion with some spans. When molding for deforming a blank, the compressive stress added to the blank is adjusted, thereby preventing wrinkles and cracks in the product.

However, the conventional art disclosed by JP-8-25097-A fails to limit the inflow of the blank from the open side of the mold, if the inflow of the blank, in the open-drawing, from the open side of the mold should be adjusted, it needs another means.

Conventionally, JP-1-197018-A alternatively discloses the art, the objective of which is to prevent wrinkles and cracks in the product.

In the conventional art disclosed by JP-1-197018-A, during the open-drawing, a work (the blank) is kept curved corresponding to a die (the mold), thereby preventing wrinkles and cracks in the pressed product.

However, the conventional art disclosed by JP-1-197018-A does not have the purpose of adjusting the deformation from the recess side of the mold positively, and it is difficult to prevent wrinkles and cracks caused by the over-inflow of the blank from the recess side of the mold.

Hereinafter, an embodiment of the conventional open-drawing is described.

A conventional mold 30 is described, with reference to FIG. 5.

For easily describing the following structure, in the direction of the standard axis in FIG. 5, the arrow X (the product longitudinal direction) shows forward, the arrow Y (the product width direction) shows rightward, the arrow Z (the product heightwise direction) shows upward.

As shown in FIG. 5, the mold 30 includes a die 31 as a cope, a blank holder 32, a punch 33 as a drag and so on.

The die 31 has a recess 31*a* on the bottom thereof in the downward and longitudinal directions including a bottom 31*f*, a left face 31*g* and a right face 31*h*. The die 31 has cushion faces 31*b* and 31*c* on the bottom thereof, and the recess 31*a* is formed between the faces. The faces 31*b* and 31*c* respectively have projected portions 31*d* and 31*e*, extending in the longitudinal direction, projecting downward on the faces 31*b* and 31*c*.

The holder 32 is formed with block portions 32*a* and 32*b* in the left and right of the holder and has the rectangular shape in plan; the portions 32*a* and 32*b* have cushion faces 32*c* and 32*d* on the top.

The faces 32*c* and 32*d* have guttered portions 32*e* and 32*f* formed on corresponding to the portions 31*d* and 31*e*, also extending in the longitudinal direction. Actually, the faces 32*c* and 32*d* of the holder 32 correspond to the faces 31*b* and 31*c* of the die 31, the face 31*b* contacts the face 32*c*, the face 31*c* contacts the face 32*d*.

The portions 2*a* and 2*b* have inside faces 2*g* and 2*h*, which form the space where the punch 3 is inserted. The distance between faces 2*g* and 2*f* is set where the punch 3 can be inserted and a blank 4 (see FIG. 6) can be deformed in the cavity 9.

The punch 33 has a upper face 33*a* formed on the top corresponding to the bottom face 31*e* of the die 31, also has side faces 33*b* and 33*c* formed on the left and right side corresponding to the faces 31*g* and 31*h* of the die 31.

A conventional open-drawing method using the mold 30 will described, with reference to FIG. 6.

A situation and a method of the setting the blank 34 to the mold 30 in the ready state will be described. Here, in FIG. 6(*b*), the mold 30 is described in plan with the perspective die 31 as a cope, the die 31 is not described (as the same as in FIGS. 2(*b*), 3(*b*), 4(*b*), 7(*b*), and 8(*b*)).

As shown in FIG. 6(*a*), when the blank 34 is set to the mold 30, the faces 32*c* and 32*d* of the holder 32 are kept upper than the face 33*a* of the punch 33, the blank 34 is set to the faces 32*c* and 32*d* of the holder 32. The die 31 is moved down and kept the position which the portions 31*d* and 31*e* of the die 31 are inserted to the portions 32*e* and 32*f* of the holder 32, the blank 34 is clamped by the portions 31*d*, 31*e* of the die 31 and the portions 32*e*, 32*f* of the holder 32.

Besides, in the mold 30, the position keeping the die 31, the height of the portion 31*d* and 31*e* and the depth of the portion 32*e* and 32*f* are adjusted respectively, thereby adjusting the clamping force for the blank 34 by the die 31 and the holder 32.

The mold 30 has a cavity 9 formed by the die 31, the holder 32 and the punch 33. The cavity 9 is formed as the desired product shape, the blank 34 is pressed along the cavity 39, the blank 34 becomes the product shape.

As shown in FIG. 6(*b*), in the typical press molding, the blank 34 has a parting line 35 set corresponding to the product form and the size thereof. The line 35 is a virtual borderline defining the remained area as the product and the cut area. The blank 34 has an excess thickness portion 36 set as the outside from the line 35. The portion 36 is cut finally and thus it is not the portion forming the product.

A drawing profile 38 is set as the border between faces 31*g*, 31*h* of the die 31 and faces 33*b*, 33*c* of the punch 33. The drawing profile comes out as the ridgeline in the corner of the finished product.

The areas X (the hatching areas in FIG. 6(*b*)) serve as clamp faces 37 constructed by the portions 31*d*, 31*e* and the portions 32*e*, 32*f*, and the faces 37 limit the movement and extension of the blank 4. Actually, the mold 30 can clamp the lateral ends of the blank 34, can not clamp the ends of the blank 34 in the recess side (the longitudinal ends).

The situation of the mold 30 and the blank 34 in the way of forming will described, with reference to FIG. 7.

As shown in FIG. 7(*a*), the die 31 and the holder 32 are moved down clamping the blank 34, thereby the ready state leads into the press molding state.

As the press molding is proceeding, the lateral ends of the blank 34 (the area A in FIG. 7(*b*)) clamped by the die 31 and the holder 32 is moved and stretched vertically to the ridgeline 33*d* and 33*e* and is deformed in the cavity 39. The blank 34 is clamped by the portions 31*d*, 31*e* and the portions 32*e*, 32*f*, so that the deformation of the lateral ends of the blank 34 in the cavity 39 is adjusted.

On the contrary, the recess side of the blank 4 (the area B in FIG. 7(*b*)) not clamped by the die 31 and the holder 32, is not directly clamped by the holder 32 and the punch 33, and is deformed in the cavity 9 in the direction parallel to the ridgeline 33*d* and 33*e*.

Adjusting the deformation amount of the blank 34 in the cavity 39 is difficult in the way of forming of the conventional press 30.

The situation of the mold 30 and the blank 34 in the finished forming will described, with reference to FIG. 8.

As shown in FIG. 8(*a*), when the die 31 and the holder 32 come to the bottom dead center, the blank 34 is press molded to the product shape by the recess 31*a* of the die 31 (faces 31*f*, 31*g*, 31*h*) and the face 33*a*, 33*b*, 33*c* of the punch 33.

When the die 31 and the holder 32 come to the bottom dead center, the lateral ends of the blank 34 (the area A in FIG. 7(*b*)) clamped by the die 31 and the holder 32 is moved and stretched vertically to the ridgeline 33*d* and 33*e* and is deformed in the cavity 39.

On the contrary, the recess side of the blank 34 (the area B in FIG. 7(*b*)) not clamped by the die 31 and the holder 32 is also clamped by the holder 32 and the punch 33, and is moved and stretched vertically to the ridgeline 33*d* and 33*e*, and is deformed in the cavity 39.

When the die 31 and the holder 32 come to the bottom dead center, the portion 36 of the recess side ends of the blank 34 can be clamped by the portion 31*f* of the die 31 and the face 33*a* of the punch 33.

Thus, the conventional mold 30 cannot adjust deformation amount of the recess side ends of the blank 34.

In the conventional open-drawing method using the mold 30, the blank 34 is deformed from the recess sides, so that the wrinkles 40 is generated inside of the parting line 35.

The parting line 35 may be set inside within the product, so that the portion 36 is extended and the loss of the blank 34 is increased, thereby the yield is decreased.

Conventionally, the open-drawing mold is not adopted, however, the press mold is adopted having the punch surrounded by the die and the blank holder, and the holding wrinkles face is formed around.

In this case, the deformation amount of the blank is adjusted rightly, but the excess thickness portion 36 clamped by the holding wrinkles face is set larger than the open-drawing mold, thereby the loss of blank 34 is increased and the yield is decreased.

The open-drawing method has advantage for improving the yield, so the open-drawing method capable of rightly adjusting the blank deformation from the recess side is desired.

DISCLOSURE OF INVENTION

Problems to be Solved by the Invention

The objective of the present invention is to prevent wrinkles and cracks in the finished product and to improve the yield of the blank, providing the new mold for the press apparatus and the open-drawing method capable of adjusting the deformation amount of the blank from the recess of the mold in the way of forming.

Means for Solving the Problems

The problem so as to be solved by the present invention are as mentioned above. Next, the means of solving the problem will be described.

The first aspect of the present invention is a mold which includes a die having cushion faces and a recess disposed in the longitudinal direction between the cushion faces, a blank holder for clamping a blank with the cushion faces and a punch formed with an upper face corresponding to a bottom of the recess and side faces corresponding to side faces of the recess, using an open-drawing forming.

In an embodiment of the mold according to the present invention, a width of the punch is gradually enlarged toward the longitudinal ends thereof in an area correspond to a excess thickness portion of the blank, and ridgelines formed between the upper face and side faces of the punch are curved to the outside of the punch width and to the longitudinal ends thereof.

In the alternative embodiment of the mold according to the present invention, the width of the punch is gradually enlarged toward the longitudinal ends thereof and the width of the recess of the die is gradually enlarged toward the longitudinal ends thereof in the area correspond to the excess thickness portion of the blank, and a drawing profile set by the punch and the die is curved to the outside of the punch width and the recess width and to the longitudinal ends thereof.

In the other mold according to the present invention, the width of the punch is gradually enlarged toward the longitudinal ends thereof in the area correspond to the excess thickness portion of the blank, and the ridgelines formed between the upper face and side faces of the punch are curved to the outside of the punch width and to the longitudinal ends thereof, and the recess width of the die is gradually enlarged toward the longitudinal ends thereof, and the drawing profile set by the punch and the die is curved to the outside of the punch width and the recess width and to the longitudinal ends thereof.

The second aspect of the present invention is an open-drawing method using the mold comprising the die having cushion faces and the recess disposed in the longitudinal direction between the cushion faces, the blank holder for clamping the blank with the cushion faces and the punch formed with the upper face corresponding to the bottom of the recess and side faces corresponding to side faces of the recess, the die, the blank holder, and the punch forms a cavity as a product shape.

In an embodiment of the open-drawing method according to the present invention, the punch is provided with a width enlarged portion toward the longitudinal ends thereof and with the curved ridgelines formed between the upper face and side faces of the punch to the outside of the punch width and to the longitudinal ends thereof in the area correspond to the excess thickness portion of the blank, the blank in the cavity is deformed along the ridgelines, and the excess thickness portion is curved to the outside of the punch width and to the longitudinal ends thereof.

In the alternative embodiment of the open-drawing method according to the present invention, the punch is provided with the width enlarged portion toward the longitudinal ends thereof, with the width enlarged portion of recess of the die toward the longitudinal ends thereof and with the curved drawing profile set the punch and the die to the outside of the punch width and recess width and to the longitudinal ends thereof in the area correspond to the excess thickness portion of the blank, and the blank is curved along the drawing profile by the die, and the excess thickness portion is curved to the outside of the punch and recess widths and to the longitudinal ends thereof.

In the advantageous embodiment of the open-drawing method according to the present invention, the punch is provided with the width enlarged portion toward the longitudinal ends thereof, with the curved ridgelines formed between the upper face and side faces of the punch to the outside of the punch width and to the longitudinal ends thereof in an area correspond to the excess thickness portion of the blank, and the blank is deformed in the cavity along the ridgelines, and the die is provided with the width enlarged portion of recess of the die toward the longitudinal ends thereof and with the curved the drawing profile set the punch and the die to the outside of the punch width and recess width and to the longitudinal ends thereof, and the blank is curved along the drawing profile by the die, and the excess thickness portion is curved to the outside of the punch width and recess width and to the longitudinal ends thereof.

Effects of the Invention

The present invention shows the following effects.

According to the present invention, the tension exerted to the outside of the recess is certainly added to the blank and the deformation amount of the blank into the cavity from the recess side of the mold is properly adjusted, thereby preventing the wrinkles and cracks in the finished product.

THE BEST MODE FOR CARRYING OUT THE INVENTION

A mold 10 for a press apparatus will be described with reference to FIG. 1.

For the following structure will be described easily, in the direction of the standard axis in FIG. 1, the arrow X (the product longitudinal direction) shows forward, the arrow Y (the product width direction) shows rightward, the arrow Z (the product heightwise direction) shows upward.

The standard axis is set described easily, does not especially limited to arranged components (a die, a blank holder, a punch, and so on) of the mold.

Figure 1:
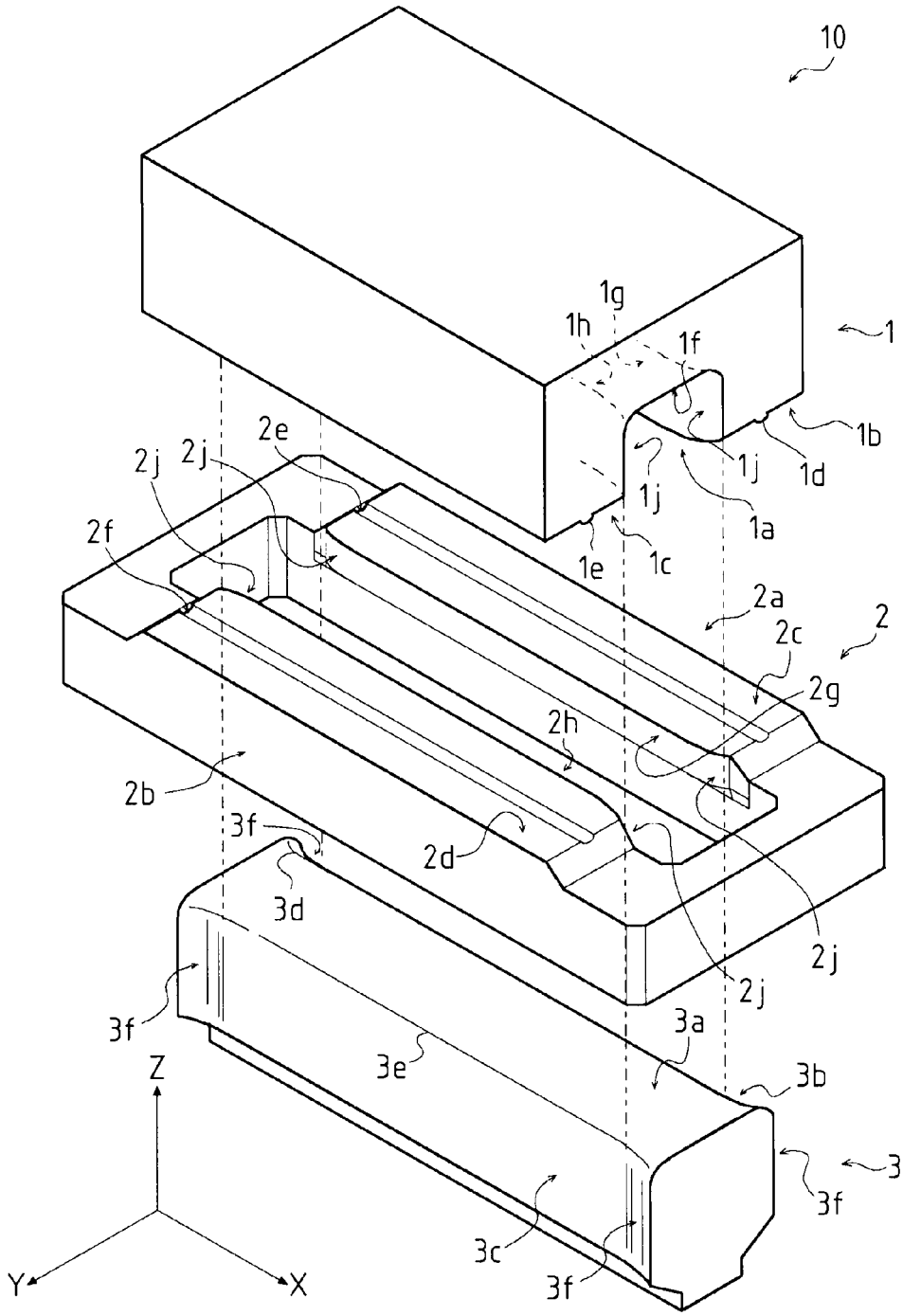
FIG. 1 is a perspective view showing a whole of a mold for a press apparatus.

As shown in FIG. 1, the mold 10 includes a die 1 as a cope, a blank holder 2, a punch 3 as a drag and so on.

The die 1 has a recess 1*a* on the bottom thereof including a bottom 1*f*, a left face 1*g* and a right face 1*h*, and the die has the recess in the downward and longitudinal directions. The die 1 has cushion faces 1*b* and 1*c* on the bottom thereof, and the recess 1*a* is formed between the faces. The faces 1*b* and 1*c* respectively have projected portions 1*d* and 1*e*, extending in the longitudinal direction, projecting downward on the faces 1*b* and 1*c*.

The die 1 has curved portions 1*j* formed at the longitudinal ends of faces 1*g* and 1*h*, curved to the outside in the direction of the axis Y (the product width direction), and in this point it is different from the conventional die 31.

The holder 2 is formed with block portions 2*a* and 2*b* in the left and right of the holder and has the rectangular shape in plan; the portions 2*a* and 2*b* have cushion faces 2*c* and 2*d* on the top.

The faces 2*c* and 2*d* have guttered portions 2*e* and 2*f* formed on corresponding to the portions 1*d* and 1*e*, also extending in the longitudinal direction. Actually, the faces 2*c* and 2*d* of the holder 2 correspond to the faces 1*b* and 1*c* of the die 1, the face 1*b* contacts the face 2*c*, the face 1*c* contacts the face 2*d*.

The portions 2*a* and 2*b* have inside faces 2*g* and 2*h*, which form the space where the punch 3 is inserted. The distance between faces 2*g* and 2*f* is set where the punch 3 can be inserted and a blank 4 (see FIG. 2) can be deformed.

The holder 2 has curved portions 2*j* formed at the longitudinal ends of faces 2*g* and 2*h* corresponding to the portions 1*j* of the die 1, curved to the outside in the direction of the axis Y (the product width direction), and in this point it is different from the conventional holder 32.

The punch 3 has a upper face 3*a* formed on the top corresponding to the bottom face 1*e* of the die 1, also has side faces 3*b* and 3*c* formed on the left and right side corresponding to the faces 1*g* and 1*h* of the die 1.

The punch 3 has curved portions 3*f* formed at the longitudinal ends of faces 3*b* and 3*c* corresponding to the portions 1*j* of the die 1 and portions 2*j* of the holder 2, curved to the outside in the axis Y (the product width direction).

The punch 3 has a ridgeline 3*d* (borderline between faces 3*a* and 3*b*), a ridgeline 3*e* (borderline between faces 3*b* and 3*c*), and thus, they and a drawing profile 8 are curved to the outside in the axis Y (the product width direction).

Figure 2:
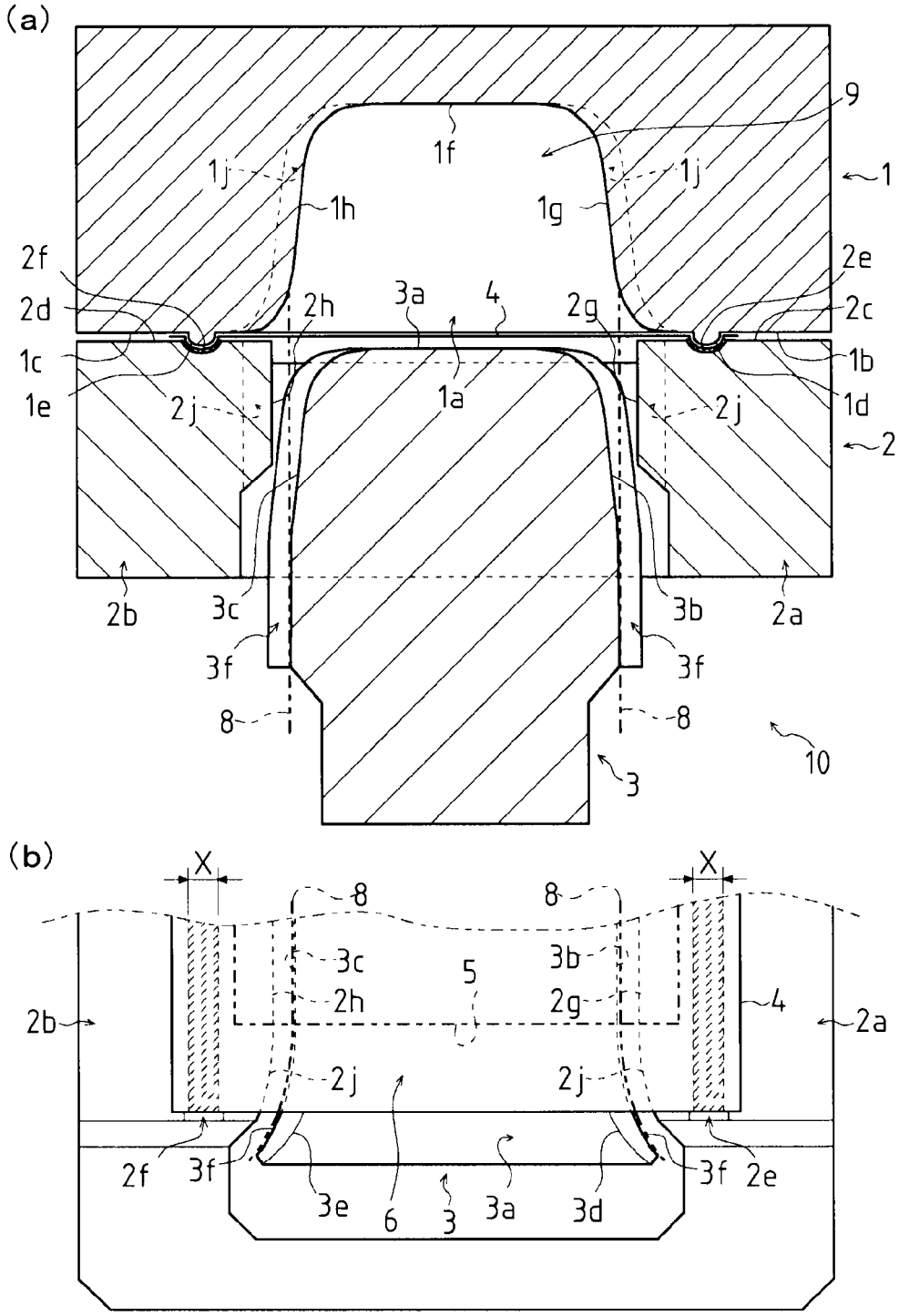
FIG. 2 is a view showing a situation of the press forming (in the ready of forming) by an open-drawing method as an embodiment of the present invention, FIG. 2(*a*) is a front section view, FIG. 2(*b*) is a partial plan view.

An open-drawing method using the mold 10 will described, with reference to FIG. 2.

A situation and a method of the setting the blank 4 to the mold 10 in the ready state will be described.

As shown in FIG. 2(*a*), when the blank 4 is set to the mold 10, the faces 2*c* and 2*d* of the holder 2 are kept upper than the face 3*a* of the punch 3, the blank 4 is set to the faces 2*c* and 2*d* of the holder 2. The die 1 is moved down and kept the position which the portions 1*d* and 1*e* of the die 1 are inserted to the portions 2*e* and 2*f* of the holder 2, the blank 4 is clamped by the portions 1*d*, 1*e* of the die 1 and the portions 2*e*, 2*f* of the holder 2.

Besides, in the mold 10, the position keeping the die 1, the height of the portion 1*d* and 1*e* and the depth of the portion 2*e* and 2*f* are adjusted respectively, thereby adjusting the clamping force for the blank 4 by the die 1 and the holder 2.

The mold 10 has a cavity 9 as the product shape formed by the die 1, holder 2 and punch 3.

As shown in FIG. 2(*b*), in the open-drawing method, the blank 4 has a parting line 5 set corresponding to the product form and the size thereof. The blank 4 has a excess thickness portion 6 set as the outside from the line 5.

The drawing profile 8 is set as the border line between faces 1*g*, 1*h* of the die 1 and faces 3*b*, 3*c* of the punch 3.

The areas X (the broken line hatching areas in FIG. 2(*b*)) serve as clamp faces 7 constructed by the portions 1*d*, 1*e* and the portions 2*e*, 2*f*, and the faces 7 adjust the movement and extension of the blank 4. Actually, the mold 10 can clamp the lateral ends of the blank 4, can not clamp the ends of the blank 4 in the recess side (the longitudinal ends).

Figure 3:
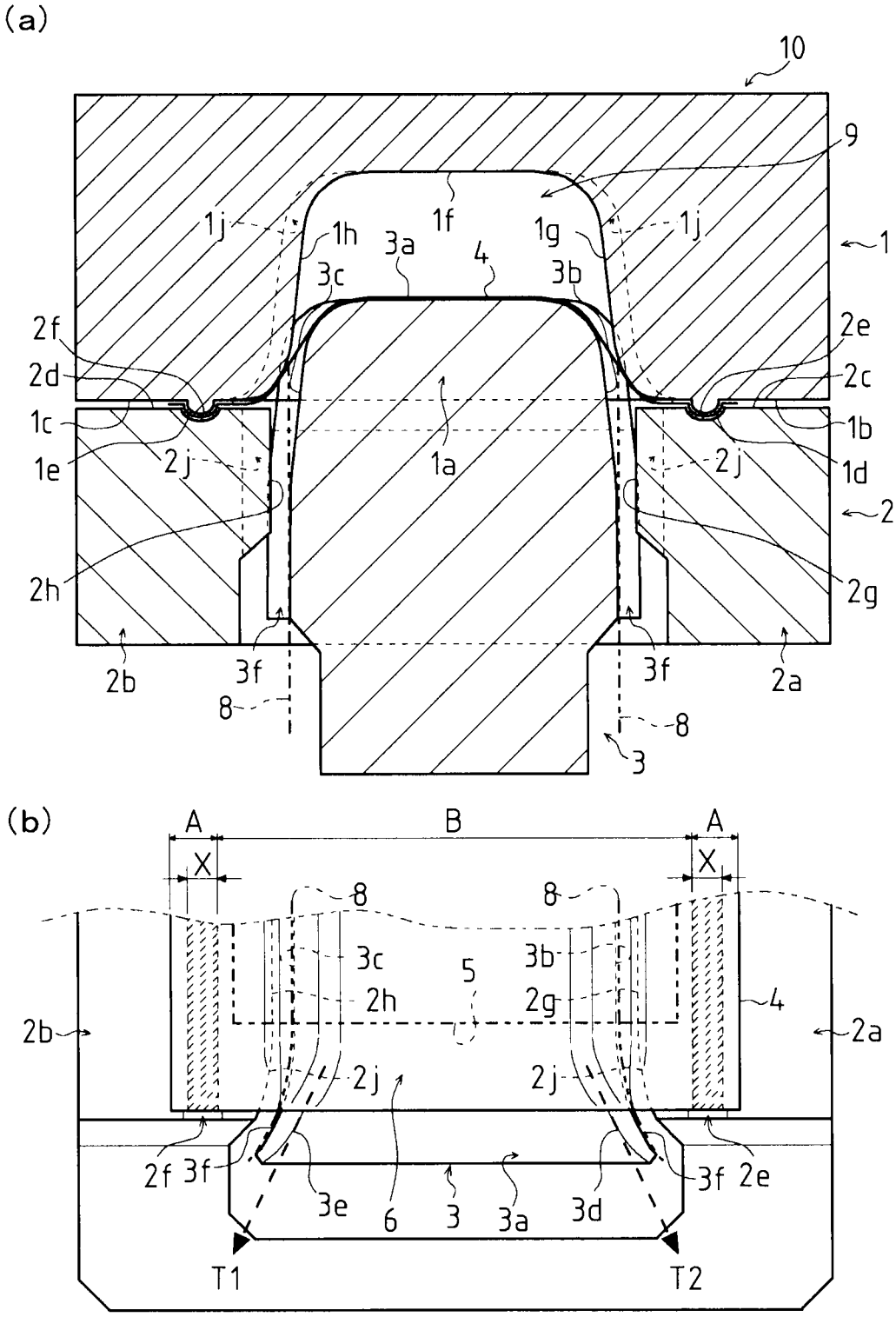
FIG. 3 is a view showing a situation of the press forming (in the way of forming) by the open-drawing method as the embodiment of the present invention, FIG. 3(*a*) is a front section view, FIG. 3(*b*) is a partial plan view.

The situation of the mold 10 and the blank 4 in the way of forming will described, with reference to FIG. 3.

As shown in FIG. 3(*a*), the die 1 and holder 2 are moved down clamping the blank 4, the ready state proceeds to the press molding state.

As the press molding is proceeding, the lateral ends of the blank 4 (the area A in FIG. 3(*b*)) clamped by the die 1 and holder 2 is moved and stretched vertically to the ridgeline 3*d* and 3*e* and is deformed in the cavity 9. The blank 4 is clamped by the portions 1*d*, 1*e* and the portions 2*e*, 2*f*, so that the deformation amount of the lateral ends of the blank 4 in the cavity 9 is adjusted.

On the contrary, the excess thickness portion 6 of the recess side of the blank 4 (the area B in FIG. 3(*b*)) not clamped by the die 1 and holder 2 is deformed in the cavity 9 curving along the ridgeline 3*d* and 3*e* which curve to the outer direction of Y axis (the product width direction). Here, as the blank 4 is curved along the ridgeline 3*d* and 3*e*, the tension is added to the blank 4, exerted to the recess side (in the longitudinal direction, for example the direction showed by the arrow T1 and T2 in FIG. 3(*b*)).

The tension is generated by deforming the portion 6 into the cavity 9 curving along the ridgelines 3*d* and 3*e*, and it should be noted that if the portions 1*j* are not formed in the die 1, the tension may be exerted.

As an embodiment of the present invention, the mold 10 includes the die 1 having faces 1*b*, 1*c* and an recess 1*a* disposed in the longitudinal direction between the faces 1*b* and 1*c*, the holder 2 for clamping the blank 4 with the faces 1*b*, 1*c* and the punch 3 formed with the face 3*a* corresponding to the bottom 1*f* of the recess 1*a* and faces 3*b*, 3*c* corresponding to faces 1*g*, 1*h* of the recess 1*a*, in which the width of the punch 3 is gradually enlarged toward the longitudinal ends thereof in the area correspond to the portion 6 of the blank 4, and in which the borderline (the ridgelines 3*d*, 3*e*) formed between the face 3*a*, 3*b*, 3*c* of the punch 3 are curved to the outside of the punch width and to the longitudinal ends thereof.

As an embodiment of the present invention, the open-drawing method using the mold 10 including the die 1 having faces 1*b*, 1*c* and the recess 1*a* disposed in the longitudinal direction between the faces 1*b* and 1*c*, the holder 2 for clamping the blank 4 with the faces 1*b*, 1*c* and the punch 3 formed with the face 3*a* corresponding to the bottom 1*f* of the recess 1*a* and faces 3*b*, 3*c* corresponding to faces 1*g*, 1*h* of the recess 1*a*, the die 3, the blank holder 2, and the punch 3 forms the cavity 9 as the product shape, providing the punch 3 with a width enlarged portion toward the longitudinal ends thereof and with curved ridgelines 3*d*, 3*e* formed between the face 3*a*, 3*b*, 3*c* of the punch 3 to the outside of the punch width and to the longitudinal ends thereof in the area correspond to the portion 6 of the blank 4, deforming the blank 4 in the cavity 9 along the ridgelines 3*d* and 3*e*, curving the portion 6 to the outside of the punch width and to the longitudinal ends thereof.

Due to the above structure, the tension exerted to the outside of the recess is certainly added to the blank 4 and the deformation amount of the blank 4 into the cavity 9 from the recess side of the mold 10 is properly adjusted, thereby preventing the wrinkles and cracks in the finished product.

At the same time the blank 4 is curved along the ridgelines 3*d* and 3*e*, the portion 6 is curved along the portions 1*j* (the drawing profile 8), so that the tension is added to the blank 4, exerted to the recess side (in the longitudinal direction, for example the direction showed by the arrow T1 and T2 in FIG. 3(*b*)).

The portion 6 is curved along the portions 1*j* (the drawing profile 8), the tension is added, and it should be noted that if the portions 1*j* are not formed in the die 1, the tension may be exerted.

As an embodiment of the present invention, the mold 10 includes the die 1 having faces 1*b*, 1*c* and the recess 1*a* disposed in the longitudinal direction between the faces 1*b* and 1*c*, the holder 2 for clamping the blank 4 with the faces 1*b*, 1*c* and the punch 3 formed with the face 3*a* corresponding to the bottom 1*f* of the recess 1*a* and faces 3*b*, 3*c* corresponding to faces 1*g*, 1*h* of the recess 1*a*, in which the width of the punch 3 is gradually enlarged toward the longitudinal ends thereof and the width of the recess 1*a* of the die 1 is gradually enlarged toward the longitudinal ends thereof in the area correspond to portion 6 of the blank 4, in which the profile 8 set by the punch 3 and the die 1 is curved to the outside of the punch width and the recess widths and to the longitudinal ends thereof.

As an embodiment of the present invention, the open-drawing method using the mold 10 including the die 1 having faces 1*b*, 1*c* and the recess 1*a* disposed in the longitudinal direction between the faces 1*b* and 1*c*, the holder 2 for clamping the blank 4 with the faces 1*b*, 1*c* and the punch 3 formed with the face 3*a* corresponding to the bottom 1*f* of the recess 1*a* and faces 3*b*, 3*c* corresponding to faces 1*g*, 1*h* of the recess 1*a*, the die 3, the blank holder 2, and the punch 3 forms the cavity 9 as the product shape, providing the punch 3 with a width enlarged portion toward the longitudinal ends thereof and with a curved ridgelines 3*d*, 3*e* formed between the face 3*a*, 3*d*, 3*e* of the punch 3 to the outside of the punch width and to the longitudinal ends thereof in the area correspond to the portion 6 of the blank 4, deforming the blank 4 in the cavity 9 along the ridgelines 3*d*, 3*e*, curving the 6 to the outside of the punch width and to the longitudinal ends thereof.

Due to the above structure, the tension exerted to the outside of the recess is certainly added to the blank 4 and the deformation amount of the blank 4 into the cavity 9 from the recess side of the mold 10 is properly adjusted, thereby preventing the wrinkles and cracks in the finished product.

When the blank is came contact with the ridgelines 3*d*, 3*e* (in the start of the open-drawing forming), the tension can be added to the blank exerting to the recess (in the longitudinal direction). In other words, as an embodiment of the present invention, in the press 10 and open-drawing method using the mold 10, the timing is not generated when the blank 4 in the recess side (the area A in FIG. 3(*b*)) is deformed in the cavity 9 not clamped by the die 1 and the holder 3.

Figure 4:
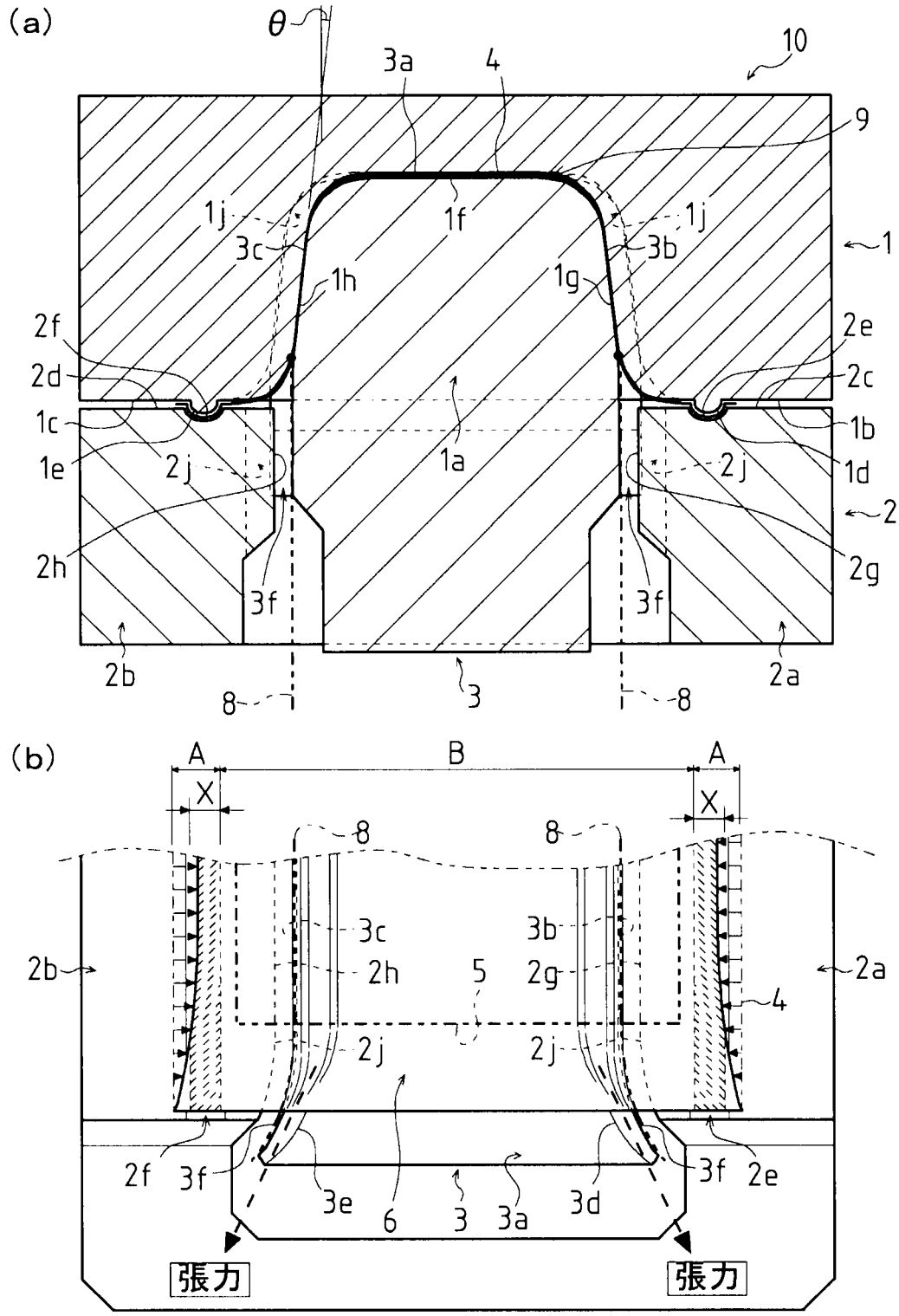
FIG. 4 is a view showing a situation of the press forming (in the finished of forming) by the open-drawing method as the embodiment of the present invention, FIG. 4(*a*) is a front section view, FIG. 4(*b*) is a partial plan view.
Figure 5:
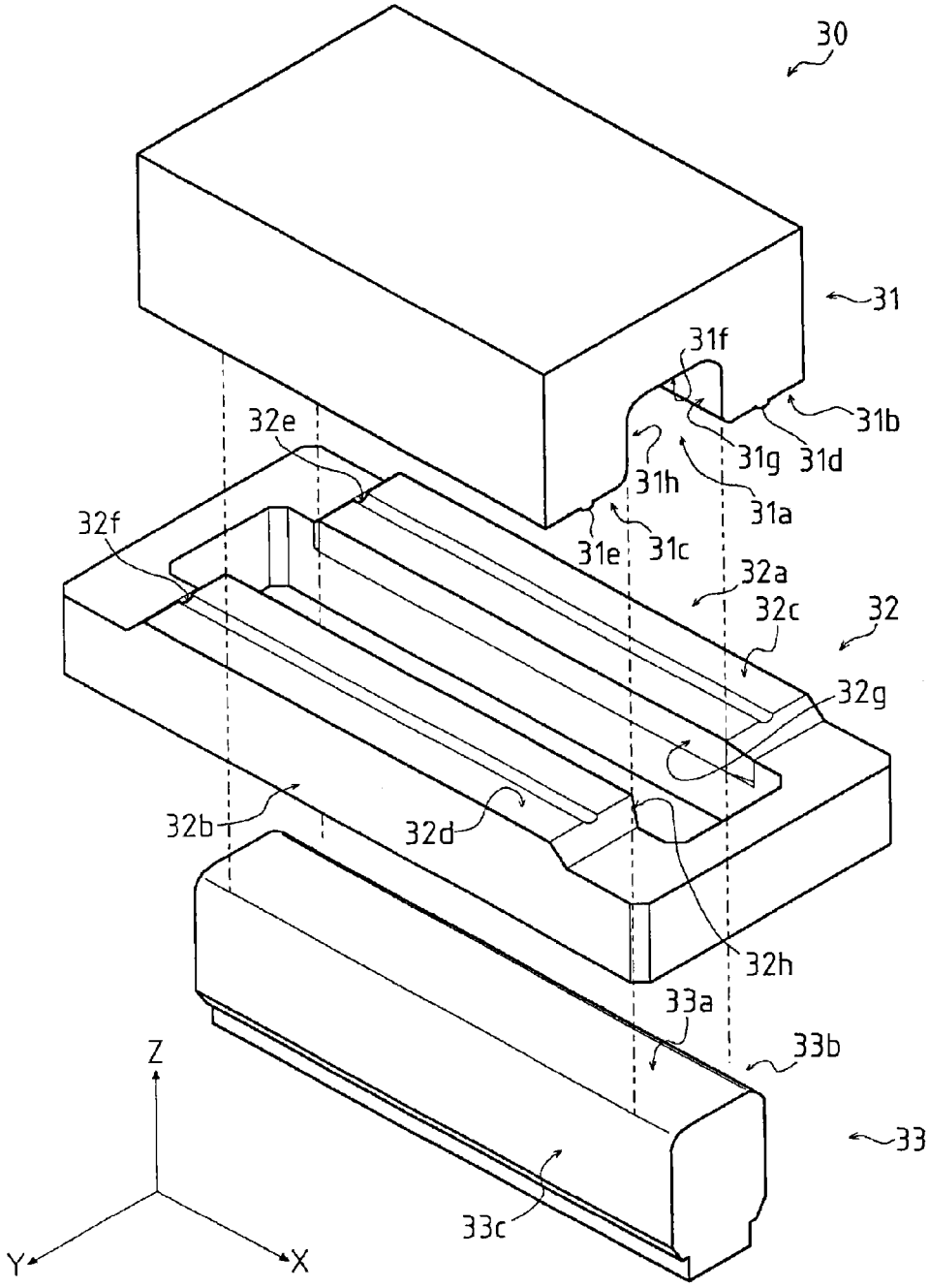
FIG. 5 Prior Art
FIG. 5 is a perspective view showing a whole of a conventional mold for a press apparatus.
Figure 6A:
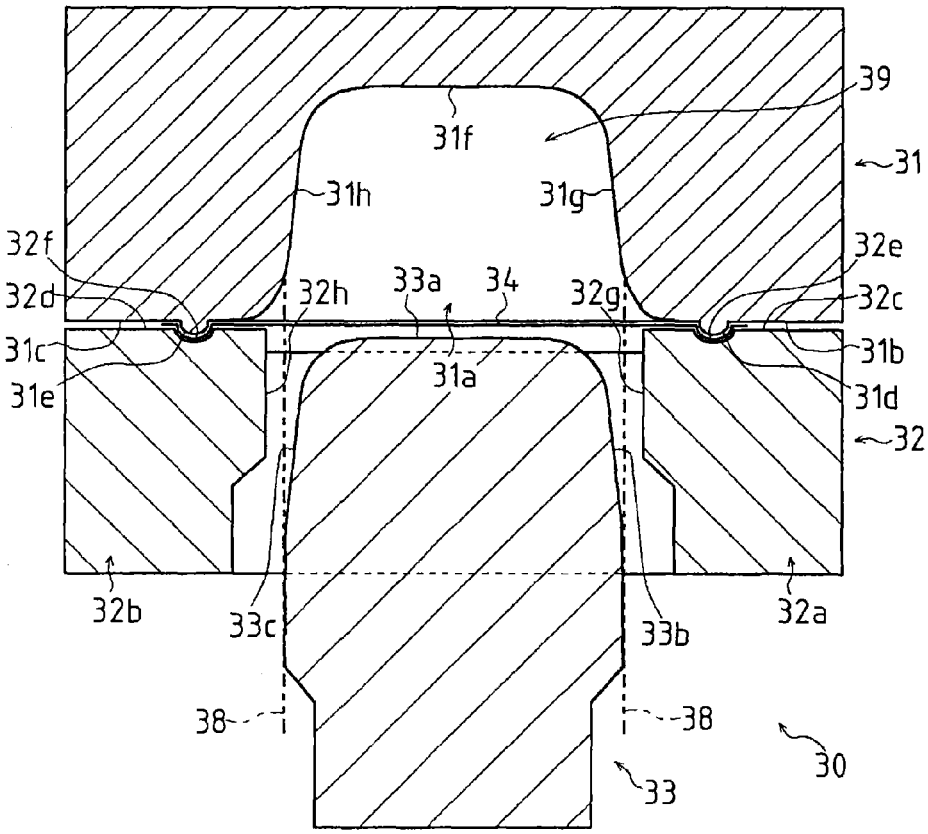
FIG. 6(a) Prior Art
FIG. 6 is a view showing a situation of the press forming (in the ready of forming) by a conventional open-drawing method, FIG. 6(*a*) is a front section view, FIG. 6(*b*) is a partial plan view.
Figure 6B:
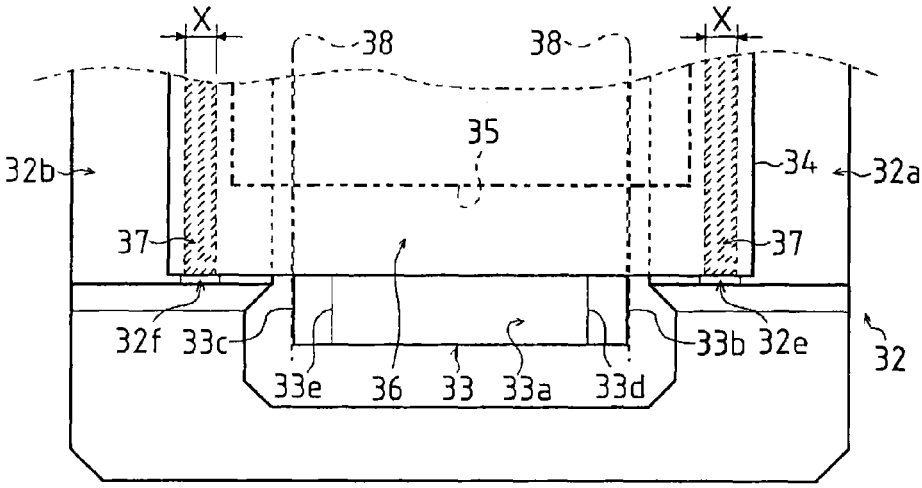
FIG. 6(b) Prior Art
Figure 7A:
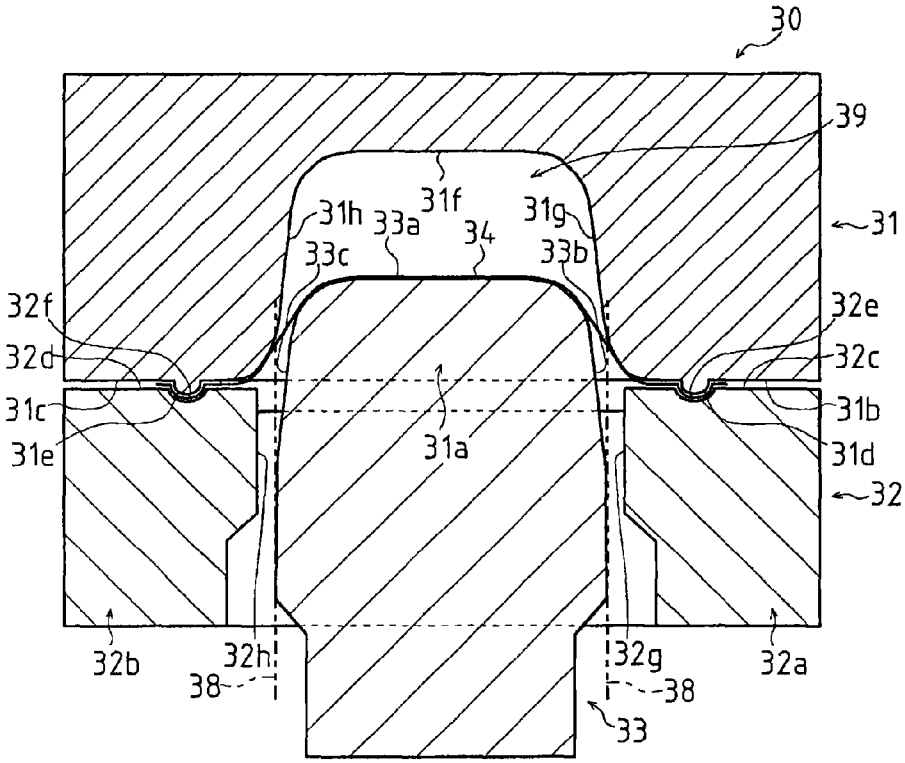
FIG. 7(a) Prior Art
FIG. 7 is a view showing a situation of the press forming (in the way of forming) by the conventional open-drawing method, FIG. 7(*a*) is a front section view, FIG. 7(*b*) is a partial plan view.
Figure 7B:
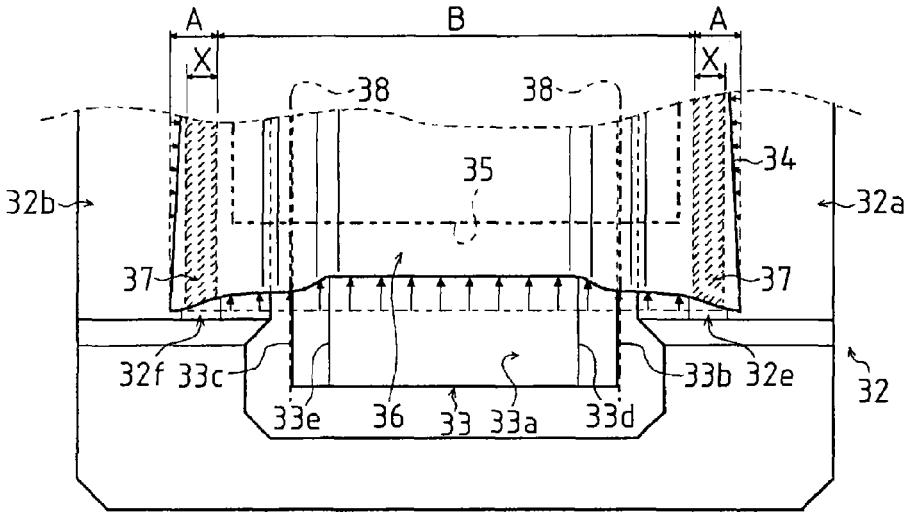
FIG. 7(b) Prior Art
Figure 8A:
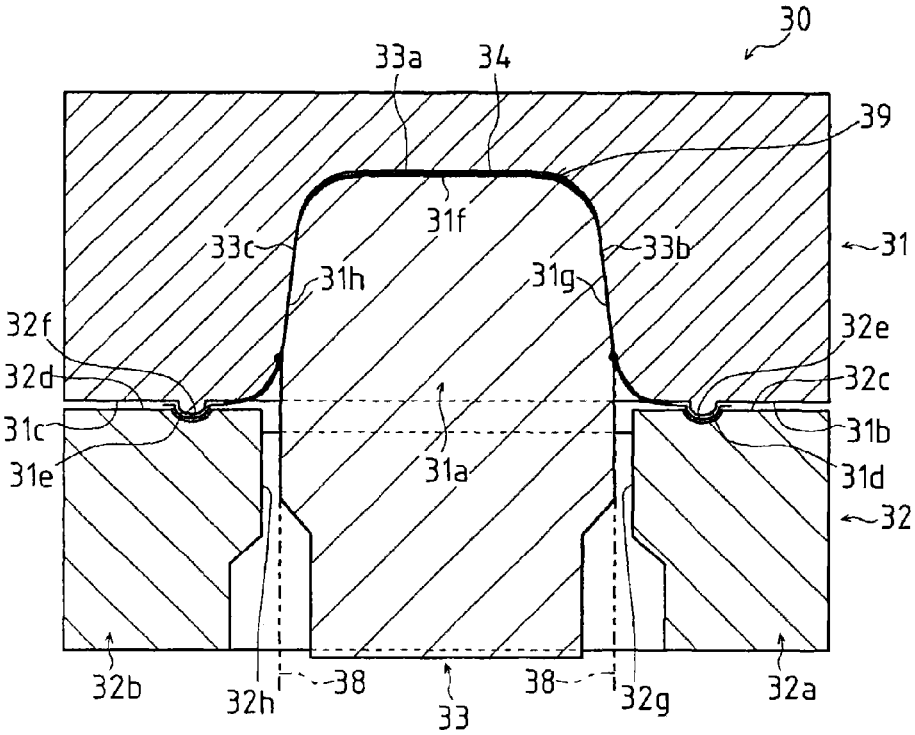
FIG. 8(a) Prior Art
FIG. 8 is a view showing a situation of the press forming (in the finished of forming) by the conventional open-drawing method, FIG. 8(*a*) is a front section view, FIG. 8(*b*) is a partial plan view.
Figure 8B:
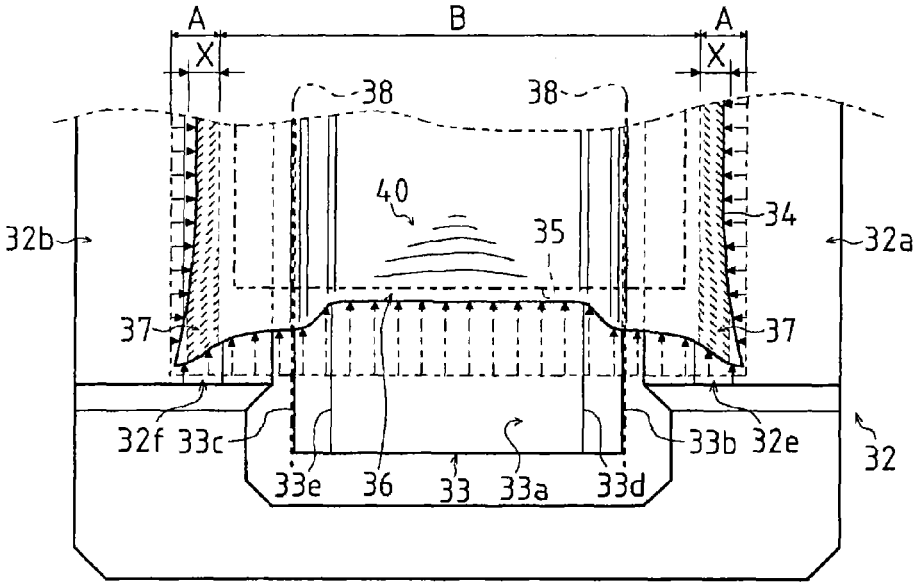
FIG. 8(b) Prior Art

The situation of the mold 10 and the blank 4 in the finished forming will described, with reference to FIG. 4.

As shown in FIG. 4(*a*), when the die 1 and holder 2 come to the bottom dead center, the lateral ends of the blank 4 (the area A in FIG. 4(*b*)) clamped by the die 1 and holder 2 is moved and stretched vertically to the ridgeline 3*d* and 3*e* and is deformed in the cavity 9.

On the contrary, the recess sides of the blank 4 (the area B in FIG. 4(*b*)) not clamped by the die 1 and holder 2 is deformed in the cavity 9 curving along the ridgeline 3*d* and 3*e*, is curved along to the curved portion 1*j* (the drawing profile 8), so that the fitting tension is added to the blank 4, exerted to the recess sides (in the longitudinal direction, for example the direction showed by the arrow T3 and T4 in FIG. 4(*b*)), thereby the deformation of the blank is limited.

As an embodiment of the present invention, the mold 10 includes the die 1 having faces 1*b*, 1*c* and the recess 1*a* disposed in the longitudinal direction between the faces 1*b* and 1*c*, the holder 2 for clamping the blank 4 with the faces 1*b*, 1*c* and the punch 3 formed with the face 3*a* corresponding to the bottom 1*f* of the recess 1*a* and faces 3*b*, 3*c* corresponding to side faces 1*g*, 1*h* of the recess 1*a*, in which the width of the punch 3 is gradually enlarged toward the longitudinal ends thereof in the area correspond to the portion 6 of the blank 4, in which the ridgelines 3*d*, 3*e* formed between the face 3*a*, 3*b*, 3*c* of the punch 3 are curved to the outside of the punch width and to the longitudinal ends thereof, in which the recess width of the die 1 is gradually enlarged toward the longitudinal ends thereof, in which the profile 8 set by the punch 3 and the die 1 is curved to the outside of the punch width and the recess width and to the longitudinal ends thereof.

As an embodiment of the present invention, the open-drawing method using the mold 10 including the die 1 having the faces 1*b*, 1*c* and the recess 1*a* disposed in the longitudinal direction between the faces 1*b* and 1*c*, the holder 2 for clamping the blank 4 with the faces 1*b*, 1*c* and the punch 3 formed with the face 3*a* corresponding to the bottom 1*f* of the recess 1*a* and the faces 3*b*, 3*c* corresponding to the faces 1*g*, 1*h* of the recess 1*a*, the die 1, the holder 2, and the punch 3 forms the cavity 9 as the product shape, providing the punch 3 with the width enlarged portion toward the longitudinal ends thereof and with curved ridgelines 3*d*, 3*e* formed between the face 3*a*, 3*b*, 3*c* of the punch 3 to the outside of the punch width and to the longitudinal ends thereof in the area correspond to the portion 6 of the blank 4, deforming the blank 4 in the cavity 9 along the ridgelines 3*d*, 3*e*, providing the die 1 with the width enlarged portion of recess toward the longitudinal ends thereof and with the curved portion of the profile 8 set the punch 3 and the die 1 to the outside of the punch width and recess width and to the longitudinal ends thereof, curving the blank 4 along the profile 8 by the die 1, curving the portion 6 to the outside of the punch width and recess width and to the longitudinal ends thereof.

Due to the above structure, the tension is generated synergistically when the portion 6 is curved along the ridgelines 3*d*, 3*e* and is curved by the die 1 along the portion 1*j* thereof, so that the tension exerted to the outside of the recess is certainly added to the blank 4 and the deformation amount of the blank 4 into the cavity 9 from the recess side of the mold 10 is properly adjusted, thereby preventing the wrinkles and cracks in the finished product.

In the open-drawing method as an embodiment of the present invention, the portion 6 in the recess side and the ends of the blank 4 are clamped in the way of forming, when the die 1 and holder 2 do not come to the bottom dead center, the deformation amount of the portion 6 in the recess side and the ends of the blank 4 can be limited. Thus, the portion 6 is not set larger, the blank 4 in the recess side can be limited.

In the open-drawing method using the press 10, the wrinkles are not occurred by the deformation of the blank 4 in the recess side unlike the conventional press 30. The portion 6 can be set smaller, thereby improving the yield.

Beside, if the curvature of the portion 1*j* of the die 1 and portion 3*f* of the punch 3 in plane is lower, the tension exerted to the longitudinal finished product is higher.

The deformation of the blank 4 in the cavity 9 is adjusted by changing the curvature of the portion 1*j*, 3*f* in plane, so that the deformation of the blank 4 is fine tuned easily by amending the mold.

If the longitudinal fall angle of the portion 6 (the angle θ in FIG. 4) in the outside of the line 5 is set narrower, the tension exerted to the recess side of the blank 4 (in the direction of the longitudinal finished product) is lower.

INDUSTRIAL APPLICABILITY

The present invention is applicable in the industrial instrument as the mold for the press apparatus and the open-drawing method using the mold, is also applicable to the mold and the method without the recess.

The invention claimed is:

1. A mold comprising:

a die having cushion faces and a recess disposed in a longitudinal direction between the cushion faces;

a blank holder for clamping a blank with the cushion faces; and a punch formed with an upper face corresponding to a bottom of the recess and side faces corresponding to side faces of the recess, wherein a width of the punch is gradually enlarged toward a longitudinal ends thereof in an area correspond to a excess thickness portion of the blank, and wherein ridgelines formed between the upper face and side faces of the punch are curved to the outside of the punch width and to the longitudinal ends thereof.

2. A mold comprising:

a die having cushion faces and a recess disposed in a longitudinal direction between the cushion faces;

a blank holder for clamping a blank with the cushion faces; and a punch formed with an upper face corresponding to a bottom of the recess and side faces corresponding to side faces of the recess, wherein a width of the punch is gradually enlarged toward a longitudinal ends thereof and a width of the recess of the die is gradually enlarged toward the longitudinal ends thereof in an area correspond to a excess thickness portion of the blank, and wherein a drawing profile set by the punch and the die is curved to the outside of the punch width and the recess widths and to the longitudinal ends thereof.

3. An open-drawing method using a mold comprising: a die having cushion faces and a recess disposed in a longitudinal direction between the cushion faces; a blank holder for clamping a blank with the cushion faces; and a punch formed with an upper face corresponding to a bottom of the recess and side faces corresponding to side faces of the recess, the die, the blank holder and the punch forms a cavity as a product shape, the method comprising:

providing the punch with a width enlarged portion toward a longitudinal ends thereof and with curved ridgelines formed between the upper face and the side faces of the punch to the outside of the punch width and to the longitudinal ends thereof in an area correspond to an excess thickness portion of the blank;

deforming the blank in the cavity along the ridgelines; and curving the excess thickness portion to the outside of the punch width and to the longitudinal ends thereof.

4. An open-drawing method using a mold comprising a die having cushion faces and a recess disposed in a longitudinal direction between the cushion faces, a blank holder for clamping a blank with the cushion faces and a punch formed with an upper face corresponding to a bottom of the recess and side faces corresponding to side faces of the recess, the die, the blank holder, and the punch forms a cavity as a product shape, the method comprising:

providing the punch with a width enlarged portion toward a longitudinal ends thereof, with a width enlarged portion of recess of the die toward the longitudinal ends thereof and with a curved drawing profile set by the punch and the die to the outside of the punch width and recess width and to the longitudinal ends thereof in an area correspond to a excess thickness portion of the blank;

curving the blank along the drawing profile by the die; and curving the excess thickness portion to the outside of the punch width and recess width and to the longitudinal ends thereof.

* * * * *